US005829231A

United States Patent [19]

Harding et al.

[11] Patent Number: 5,829,231

[45] Date of Patent: Nov. 3, 1998

[54] AUTOMATED CUSHIONING PRODUCING AND FILLING SYSTEM

[75] Inventors: Joseph J. Harding, Mentor; Richard O. Ratzel, Westlake; James A. Simmons, Jr., Painesville, all of Ohio

[73] Assignee: Ranpak Corporation, Painesville, Ohio

[21] Appl. No.: 749,115

[22] Filed: Nov. 14, 1996

[51] Int. Cl.[6] ..... B26D 7/06; B65B 55/20; B65B 61/22

[52] U.S. Cl. ..... 53/493; 53/55; 53/115; 53/139.5; 53/472; 493/25; 493/464; 493/967

[58] Field of Search ..... 53/493, 55, 504, 53/472, 139.5, 115, 117, 121, 530, 529, 157, 155, 238, 237; 493/967, 464, 25, 37, 352, 346, 381

[56] References Cited

U.S. PATENT DOCUMENTS

| | | | |
|---|---|---|---|
| 2,101,170 | 12/1937 | Engel | 271/76 |
| 3,509,797 | 5/1970 | Johnson | 493/967 X |
| 3,621,981 | 11/1971 | Nimmo et al. | 198/40 |
| 3,820,648 | 6/1974 | Halvorsen | 198/34 |
| 3,949,856 | 4/1976 | Ulber et al. | 197/133 R |
| 4,073,375 | 2/1978 | Hart et al. | 198/466 |
| 4,085,928 | 4/1978 | Sussman | 270/61 R |
| 4,120,393 | 10/1978 | Motooka et al. | 198/460 |
| 4,231,465 | 11/1980 | Bourgeois | 198/460 |
| 4,237,776 | 12/1980 | Ottaviano | 493/967 X |
| 4,261,456 | 4/1981 | Scarpa et al. | 198/460 |
| 4,355,712 | 10/1982 | Bruno | 198/460 |
| 4,385,537 | 5/1983 | Wolf | 83/100 |
| 4,488,846 | 12/1984 | Halberschmidt et al. | 414/152 |
| 4,557,716 | 12/1985 | Ottaviano | 493/464 |
| 4,588,884 | 5/1986 | Priscott | 250/223 R |
| 4,619,635 | 10/1986 | Ottaviano | 493/36 |
| 4,641,271 | 2/1987 | Konishi | 364/478 |
| 4,719,449 | 1/1988 | Cousseau | 340/347 P |
| 4,746,255 | 5/1988 | Roccabianca et al. | 414/84 |
| 4,922,687 | 5/1990 | Chow et al. | 53/472 |
| 4,925,005 | 5/1990 | Keller | 198/460 |
| 4,938,007 | 7/1990 | Sperry | 53/472 X |
| 4,949,607 | 8/1990 | Yuito | 83/76.7 |
| 4,987,809 | 1/1991 | Price | 83/27 |
| 5,008,842 | 4/1991 | Nagai et al. | 364/551.01 |
| 5,016,182 | 5/1991 | Bergland et al. | 364/469 |
| 5,092,450 | 3/1992 | Schommartz et al. | 198/460 |
| 5,097,939 | 3/1992 | Shanklin et al. | 198/419.2 |
| 5,123,889 | 6/1992 | Armington et al. | 493/352 |
| 5,136,222 | 8/1992 | Yamamoto et al. | 318/568.2 |
| 5,149,075 | 9/1992 | Crowley et al. | 270/39 |
| 5,252,899 | 10/1993 | Kalamura et al. | 318/568.1 |
| 5,285,887 | 2/1994 | Hall | 198/460 |
| 5,292,238 | 3/1994 | Michalak | 425/9 |
| 5,322,477 | 6/1994 | Armington et al. | 493/346 |
| 5,487,717 | 1/1996 | Tekavec et al. | 493/352 |

FOREIGN PATENT DOCUMENTS

| | | |
|---|---|---|
| 274188 | 12/1989 | German Dem. Rep. . |
| 2741443 | 3/1979 | Germany . |
| 3315520 | 11/1983 | Germany . |
| 9513914 | 5/1995 | WIPO . |

*Primary Examiner*—James F. Coan
*Attorney, Agent, or Firm*—Renner, Otto, Boisselle & Sklar, P.L.L.

[57] ABSTRACT

An automated cushioning producing and filling system includes a cushioning conversion machine which converts stock paper into cut pads of a selected length and transports the pads to a staging location, a pad sensor for sensing the presence of a pad in the staging location, a box transporting system for transporting a box from a remote location to a filling location, a box sensor for sensing the presence of a box in the filling location, a bar code reader for reading a bar code from the box indicative of the packaging requirements of the box when the box sensor has sensed the presence of a box in the filling location, a pad transferring apparatus for transferring a pad from the staging location to the box when the pad sensor has sensed the presence of a pad in the staging area, and a system controller for determining the box packaging requirements from the code read by the bar code reader and instructing the cushioning conversion machine to produce pads in accordance with the packaging requirements for the box.

15 Claims, 7 Drawing Sheets

AUTOMATED CUSHIONING PRODUCING AND FILLING SYSTEM

FIELD OF THE INVENTION

This invention relates generally to an automated cushioning system which determines the packaging requirements of a container, produces a cushioning product or products of a desired length and automatically places the cushioning product into a container.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; and 4,968,291. (These patents are all assigned to the assignee of the present invention and their entire disclosures are hereby incorporated by reference.) Such a cushioning conversion machine converts sheet-like stock material, such as paper in multi-ply form, into low density cushioning pads or dunnage.

A cushioning conversion machine, such as those disclosed in the above-identified patents, may include a stock supply assembly, a forming assembly, a gear assembly, and a cutting assembly, all of which are mounted on the machine's frame. During operation of such a cushioning conversion machine, the stock supply assembly supplies the stock material to the forming assembly. The forming assembly causes inward rolling of the lateral edges of the sheet-like stock material to form a continuous strip having lateral pillow-like portions and a thin central band. The gear assembly, powered by a feed motor, pulls the stock material through the machine and also coins the central band of the continuous strip to form a coined strip. The coined strip travels downstream to the severing or cutting assembly which severs or cuts the coined strip into pads of a desired length.

Typically, an operator must interact with the cushioning conversion machine for the production of the length of pads and number pads necessary to meet the packaging requirements of a box or container. This is often done through use of a foot switch or through specific lengths entered into the machine through the use of a thumbwheel or keypad, for example. Once the requested pad is formed it is transferred downstream to a transitional zone, such as a table, a conveyor, a bin, etc., where the pad is stored. Thereafter an operator would manually remove the pad from the transitional zone and manually insert the pad within a container for cushioning purposes. It would be desirable to automate the process of determining the packaging requirements of a box or container, communicating the packaging requirements to the cushioning conversion machine, and placing the formed pad into the box.

SUMMARY OF THE INVENTION

The present invention provides an automated cushioning conversion system which automatically conveys a box to a location to be filled with packaging material, determines the amount of cushioning material needed for the box by reading a code on the box, produces the required amount of cushioning material and transfers the material to the box.

In accordance with one aspect of the invention, a cushioning conversion system includes a cushioning conversion machine which converts stock paper into cut pads of a selected length and transports the pads to a staging location, a pad sensor for detecting the presence of a pad in the staging location, a box transport system, such as a conveyor, for transporting a box from a remote location to a filling location, a reading element for reading a code from the box indicative of the packaging requirements of the box when the box is in the filling location, a pad transferring apparatus for transferring a pad from the staging location to the box when the pad sensor detects the presence of a pad in the staging area, and a system controller for determining the box packaging requirements from the code read by the reading element and instructing the cushioning conversion machine to produce pads in accordance with the packaging requirements for the box.

In accordance with a further aspect of the invention a cushioning conversion system includes a cushioning conversion machine which converts stock paper into cut pads of a selected length and transports the pads to a staging location, a pad sensor for sensing the presence of a pad in the staging location, a box transport system for transporting a box from a remote location to a filling location, a box sensor for sensing the presence of a box in the filling location, a bar code reader for reading a bar code from the box indicative of the packaging requirements of the box when the box sensor has sensed the presence of a box in the filling location, a pad transferring apparatus for transferring a pad from the staging location to the box when the pad sensor has sensed the presence of a pad in the staging area, and a system controller for determining the box packaging requirements from the code read by the reading element and instructing the cushioning conversion machine to produce pads in accordance with the packaging requirements for the box.

In general, the invention comprises the foregoing and other features hereinafter fully described and particularly pointed out in the claims, the following description and the annexed drawings setting forth in detail a certain illustrated embodiment of the invention, this being indicative, however, of but one of the various ways in which the principles of the invention may be employed.

DETAILED DESCRIPTION OF THE INVENTION

Figure 1:
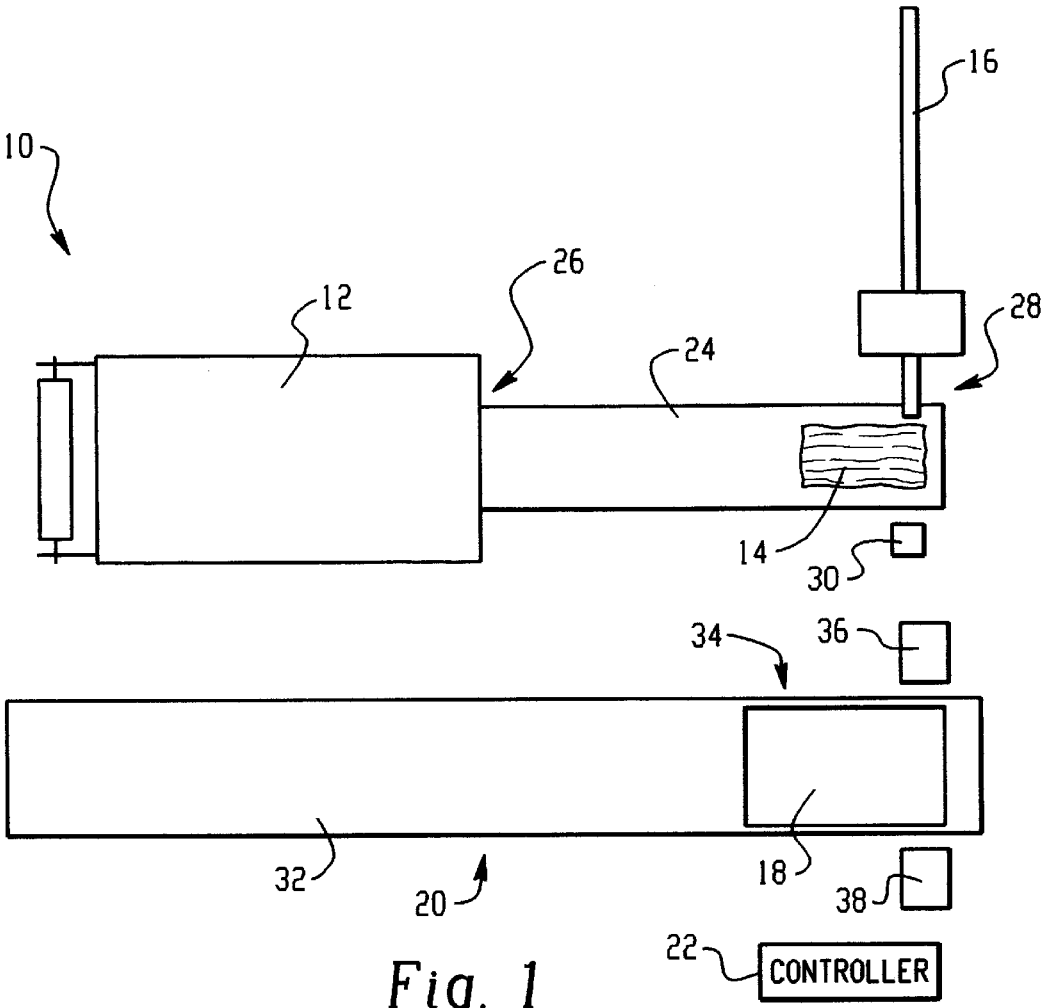
FIG. 1 is a schematic layout of the automatic cushioning system of the present invention.
Figure 2:
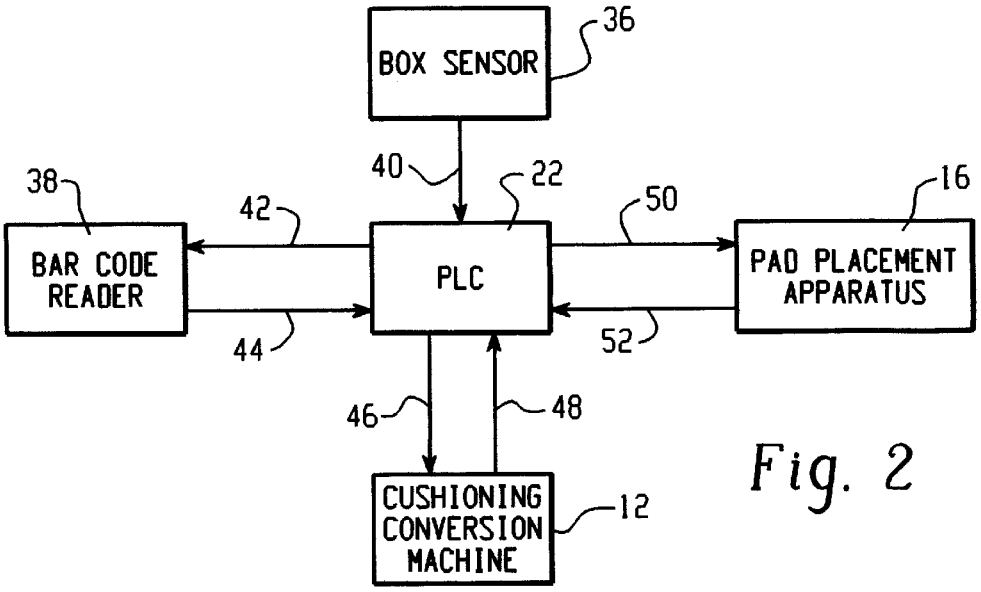
FIG. 2 is a schematic diagram of the communications and control between the components of the automatic cushioning system.

With reference to the drawings and initially to FIGS. 1 and 2, there is shown an automated cushioning system 10 including a cushioning conversion machine 12 for producing a cushioning product, such as a pad 14, a pad placement apparatus 16 for automatically removing the pad from the machine 12 and transferring the pad to a second location, such as in a box 18, a box conveyor assembly 20 for conveying the box to be filled with one or more pads to a location accessible by the pad placement apparatus 16, and a system controller 22 for controlling the coaction and interaction of the cushioning conversion machine, the pad placement apparatus and the box conveyor assembly.

In addition to various components devoted to the conversion of a stock material, such as paper, to a pad as are described more fully below, the cushioning conversion machine 12 includes a pad conveyor assembly 24 which conveys the pad from the machine exit 26 after being formed and cut to a staging location 28 from which the pad placement apparatus 16 can engage the pad and transfer it to the box 18. A pad sensor 30, such as an optical sensor, located at the end of the pad conveyor assembly 24 in the staging area 28 senses the presence of a formed pad in the staging area.

The box transport assembly 20 includes a conveyor 32, which may for example be a series of powered rollers or a belt, which urges the box 18 toward a filling position 34 accessible by the pad placement apparatus 16, a box present sensor 36 located adjacent the filling position for determining when a box is in place and ready to be filled with the desired amount of pad material and a reading element 38, such as a bar code reader, for reading a code associated with the box 18 indicative of the number and lengths of pads to be placed in the box. The reading element 38 and code may be implemented through a variety of known equivalents including, for example, optical character readers and characters, magnetic readers and magnetic tags or radio frequency readers and tags. Alternatively, the reading element 38, can be replaced by a volumetric sensor, such as a pressures sensor or an ultrasonic sensor to determine the number of pads 14 necessary to adequately fill the box 18 or cushion the contents of the box. Further, the code need not be printed or applied to the box 18, but may also be applied to an invoice or shipping record or affixed to a tote or larger container into which the box 18 is placed. The reading element 38 may also be placed upstream of the filling location 34 to read the box 18 at an earlier point or to read the box while moving on the conveyor 32.

The system controller 22 is preferably implemented through a commercially available programmable logic control (PLC) device or other processing element.

In operation, the box conveyor 32 will convey a box 18 from a remote location where the box has been loaded or filled with the desired product or products toward the filling position 34. Once the box 18 has reached the filling position 34, its presence is sensed by the box sensor 36, which relays the detection of the box in the filling position to the system controller 22 over the exemplary signal line 40 as shown more particularly in FIG. 2. (The signal line 40 and other signal lines described below are merely conveniently exemplary embodiments for the purposes of description and can be dedicated conductors or wires in a serial or parallel arrangement or other means of communication as will be understood by a person of skill in the art.)

Upon being informed of the presence of a box in the filling position 34, the controller 22 instructs the bar code reader 38 over signal line 42 to read a bar code (not shown) located on the side of the box 18. The bar code reader 38 reads the information encoded on the bar code and supplies the information to the system controller 22 over the signal line 44. The system controller 22 decodes the data read by the bar code reader 38 and determines from the data the number of pads and pad lengths desired to be formed and placed in the box 18. The bar code information may be a single number from which the controller 22 can determine the box type and then look up the number of pads and the corresponding pad lengths in a look-up table. Alternatively, the bar code may itself indicate the number of pads and respective pad lengths desired for placement in the box 18. The code may also be used as an indicator or pointer to an associated packaging requirement stored in a separate computer, for example, a personal computer or mainframe machine, such as one which might be used for controlling other filling, packaging and/or shipping operations.

Based on the information from the bar code, the system controller 22 provides the cushioning conversion machine 12 with the number of pads to be produced and the length of the pads and instructs the machine to produce a pad over the signal line 46. The cushioning conversion machine 12 will then produce a pad of the instructed length. Once the pad 14 has been completed, it is transported to the staging location 28 where its presence is detected by the pad sensor 30. The signal produced by the pad sensor 30 may be provided to the cushioning conversion machine 12 for relay to the system controller 22 over the signal line 48 or it may be provided to the system controller 22 directly.

Upon learning that the pad 14 has been produced and is in the staging location 28, the system controller 22 instructs the pad placement apparatus 16 over the signal line 50 with positional feedback information over the signal line 52 to engage the pad 14 and transfer the pad from the staging area 28 to the box 18. If all of the pads to be inserted into the box 18 have been formed and placed in the box, the operator can manually remove the box or the box can be moved further down the conveyor 32, such as through an automated gating system as discussed below relative to FIG. 9, to another station for other operations, such as automated closure and sealing of the box or removal of the box. If the system controller 22 had instructed the cushioning conversion machine 12 that more than a single pad is needed for placement in the box 18, the cushioning conversion machine will have begun producing the second pad once or shortly after the placement apparatus 16 has removed the pad 14 from the staging location 28 and the pad sensor 30 has detected the absence of the pad from the staging location.

Upon the second or further pad being formed as indicated by the pad sensor 30 now detecting a completed pad in the staging location 28 and the pad detection having been relayed to the system controller 22, the system controller will again instruct the pad placement apparatus 16 to engage the pad and transport it to the box 18. Any additional pads needed for placement in the box will continue to be produced by the cushioning conversion machine 12 and placed in the box 18 by the box placement apparatus 16 as described above until the number of pads indicated on the bar code have been placed in the box.

After the box 18 has been manually removed from the conveyor 32 or has further progressed on the conveyor past the filling position 34, the system controller 22 will detect the absence of the box 18 by a change in the signal received from the box sensor 36 and await the detection of a further box 18 in the filling position. Upon the detection of a further box 18 in the filling position 34 by the box sensor 36, the bar code reader 38, the cushioning conversion machine 12 and the pad placement apparatus 16, under the control of the controller 22, will read the bar code on the box, produce and place in the box the desired number of pads of appropriate lengths as described above. In such a manner the coordinated action of the conveyor assembly 20, cushioning conversion machine 12 and pad placement apparatus 16 can be controlled to automatically determine the padding requirements of a box and to fill the box with the desired number of pads of appropriate length without extensive assistance from an operator.

Turning then to a more detailed discussion of the individual components of the automated cushioning system 10, and first to the cushioning conversion machine 12 as shown in FIGS. 3 through 7, in addition to the pad conveyor 24 the cushioning conversion machine 12 includes a frame 60 by which are supported the various components for converting stock material, such as kraft paper, to a strip of cushioning product and cutting the strip into pads of the desired length. Such components include a stock supply assembly 62, a forming assembly 64 for forming the stock material into the strip of cushioning product, a feed assembly 66 for feeding stock material through the forming assembly and a cutting assembly 68 which cuts the strip of cushioning product into pads of a desired length. These components and their functioning are described more fully in U.S. patent application Ser. No. 08/188,305, which is incorporated herein through this reference. The operation of the feed assembly 66 and the cutting assembly 68 which cooperate to produce a pad of the length requested by the system controller 22 are controlled by a machine controller (shown schematically at 70), such as the machine controller described in co-owned U.S. patent application Ser. Nos. 08/279,149 and 08/482,015 which are incorporated herein by this reference. In some instances the functions of the system controller 22 and the machine controller 70 may be implemented through a single processor, or further divided for implementation by additional processing elements or controllers.

During the conversion process, the feed assembly 66 draws the continuous strip of stock material from the stock supply assembly 62 and through the forming assembly 64 by the action of two cooperating and opposed gears 72 which are rotated through power supplied by the feed motor 74. As the strip of stock material is drawn through the forming assembly 64, the forming assembly causes the lateral edges of the stock material to roll inwardly to form a continuous strip having two lateral pillow-like portions and a central band therebetween. The opposed gears 72 of the feed assembly 66 additionally perform a "coining" or "connecting" function as the gears coin the central band of the continuous strip as it passes through the nip of the gears to form a coined strip. As the coined strip travels downstream from the feed assembly 66, the cutting assembly 68, powered by the cut motor 76, cuts the strip into sections or pads of a desired length. A cut pad is conveyed from the machine exit 26 to the staging location 28 by the pad conveyor 24 where they await retrieval and placement by the pad placement apparatus 16.

The machine controller 70 controls the feed motor 74 powering the feed assembly 66 as a function of the inputs received from the system controller 22 and the pad detection signal provided by the pad sensor 30 as well as other inputs to the machine controller. For example, if the system controller 22 has determined based on the bar coding on the box 18 in the filling location 34 (FIG. 1) that two pads of 12 inches each (or of varying individual lengths) are required to fill the box, the machine controller 70 will be instructed to produce two 12 inch pads. The machine controller 70 will check the status of the input from the pad sensor 30 to determine whether there is a pad 14 in the staging location 28 and assuming that there is not, will instruct the feed motor 74 to run for an appropriate length of time for the feed assembly 66 to draw sufficient paper through the forming assembly 64 to create a 12 inch pad. The machine controller 70 will then cause the cutting apparatus 68 to cut the pad and the pad conveyor assembly 24 will convey the cut pad to the staging location 28. Upon the pad 14 reaching the staging location 28, the pad sensor 30 will notify the machine controller 70 of the presence of a pad in the staging location 28 and the machine controller will in turn notify the system controller 22. Once the system controller 22 has caused the pad placement apparatus 16 to remove the pad from the staging location 28, machine controller 70 will detect the fact that the first pad has been removed based on the signal received from the pad sensor 30 and will produce another pad in the same manner as the first was produced. Alternatively, the pad sensor 30 signal can be relayed or communicated directly to the system controller 22, which can instruct the cushioning conversion machine 12 to produce a second pad of the determined length.

Figure 5:
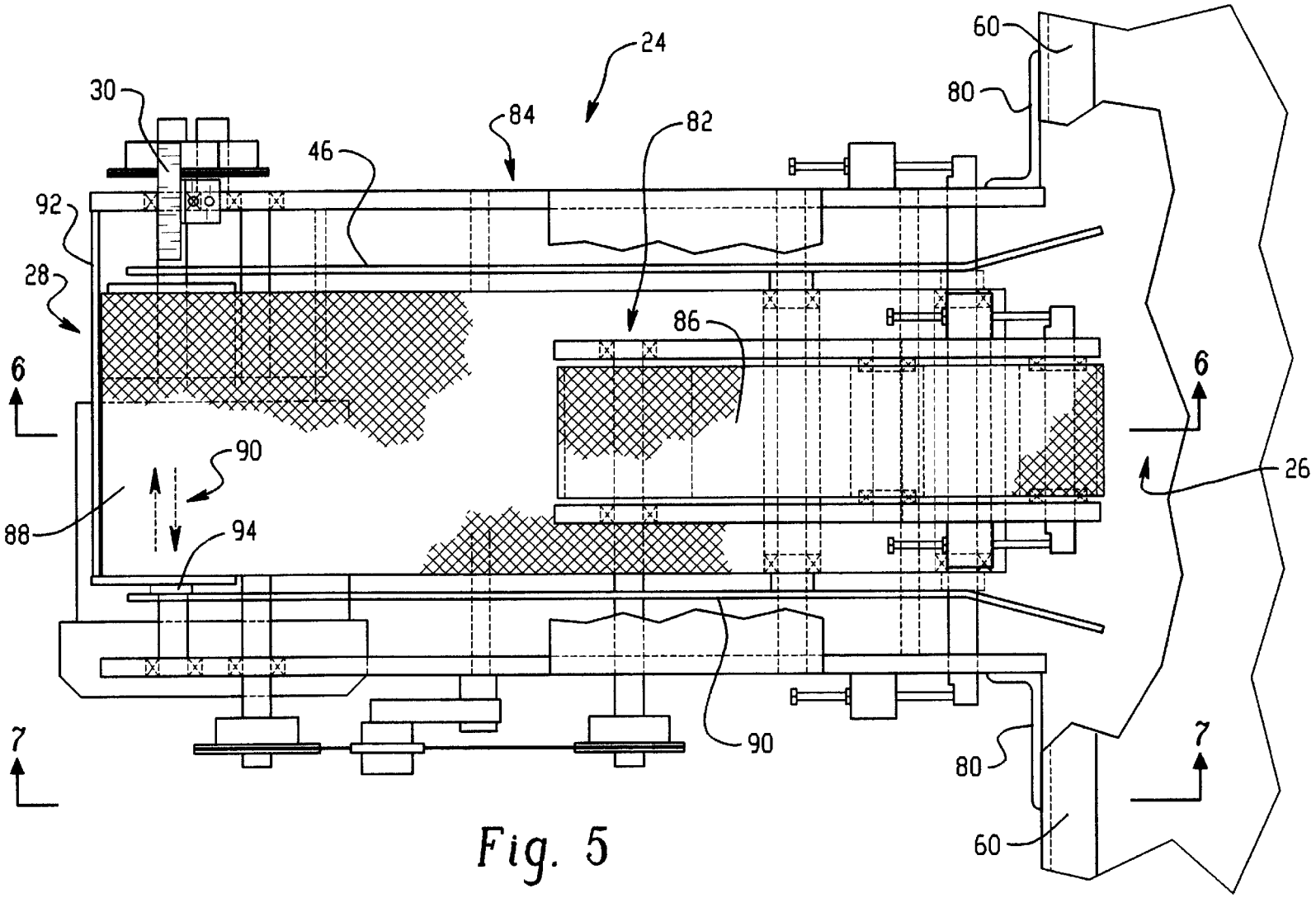
FIG. 5 is a partial close-up view of the conveyor assembly of the cushioning conversion machine.
Figure 6:
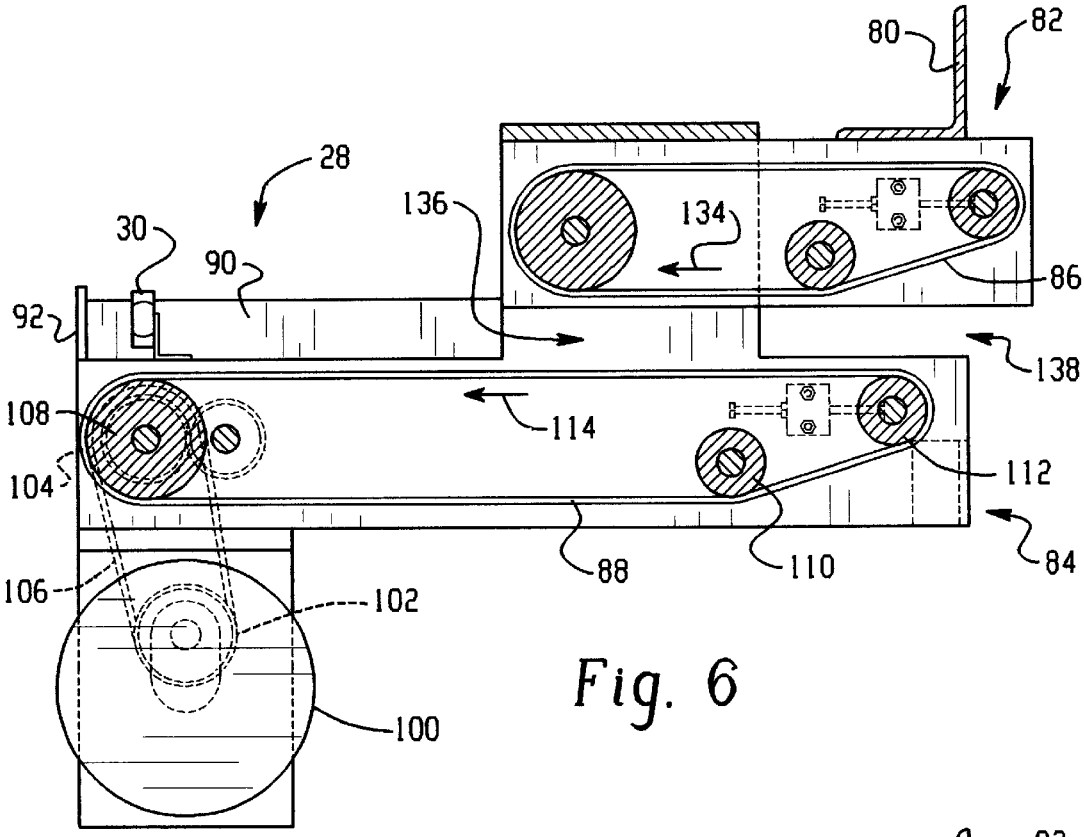
FIG. 6 is a cross-sectional view of the conveyor assembly of FIG. 5 taken generally along the line 6—6 in FIG. 5.
Figure 7:
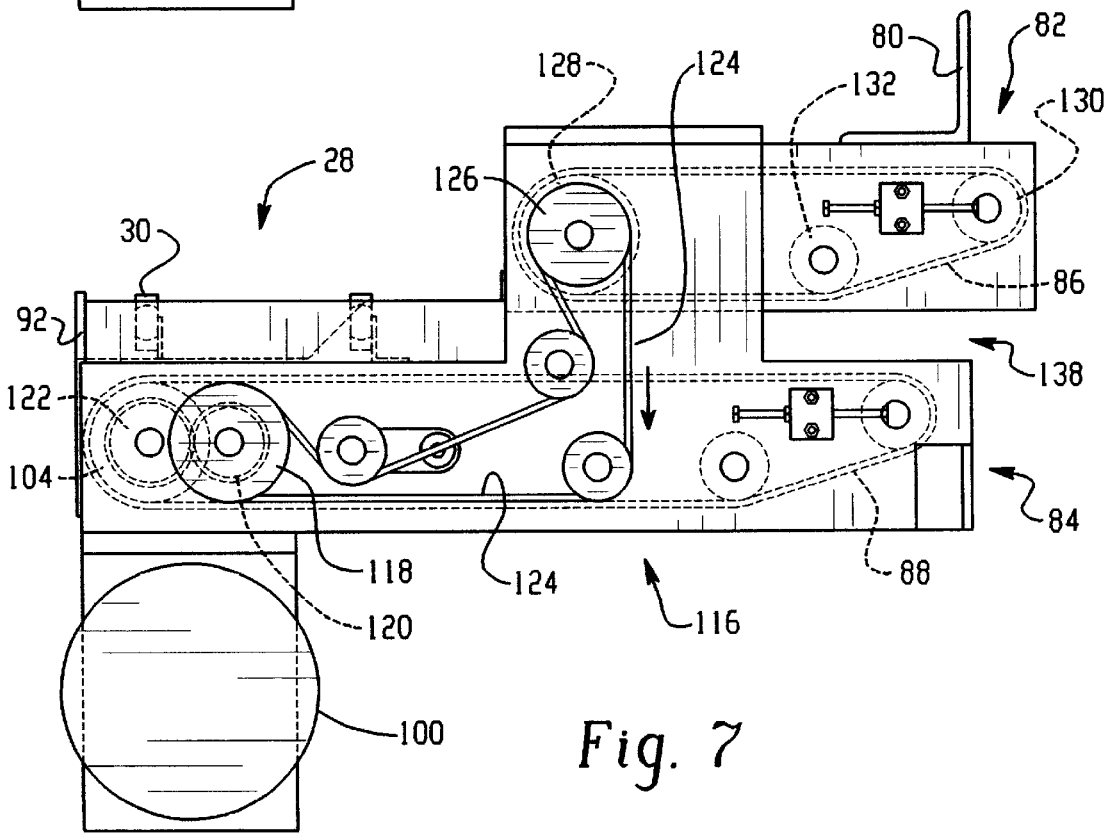
FIG. 7 is a view of the side of the conveyor assembly looking from the line 7—7 in FIG. 5.

An exemplary pad conveyor 24 is shown in detail in FIGS. 5 through 7. The pad conveyor assembly 24 is positioned adjacent the exit 26 of the cushioning conversion machine 12 to receive a cut pad and is preferably mounted to the machine frame 60 such as by mounting flanges 80. The pad conveyor assembly 24 includes an upper conveyor belt assembly 82 and a lower conveyor belt assembly 84. The upper and lower conveyor belt assemblies 82, 84 each include a conveyor belt 86, 88, respectively, which confront each other and are spaced to gently compress and frictionally engage the cut pad therebetween to transfer the pad from the machine exit 26 to the staging area 28. Preferably, the pad contacts at least one of the conveyor belts 86, 88 prior to or immediately after being cut by the cutting assembly 68 (FIG. 4) so that the cut pad is immediately moved from the machine exit 26 to the staging location 28. The conveyor belts 86 and 88 may be one of many suitable types and finishes with a coefficient of friction between the conveyor belt and the pad so as to cause the pad to move along with the conveyors to the staging location 28 prior to being retrieved by the pad placement apparatus 16 without damage to the pad.

Figure 3:
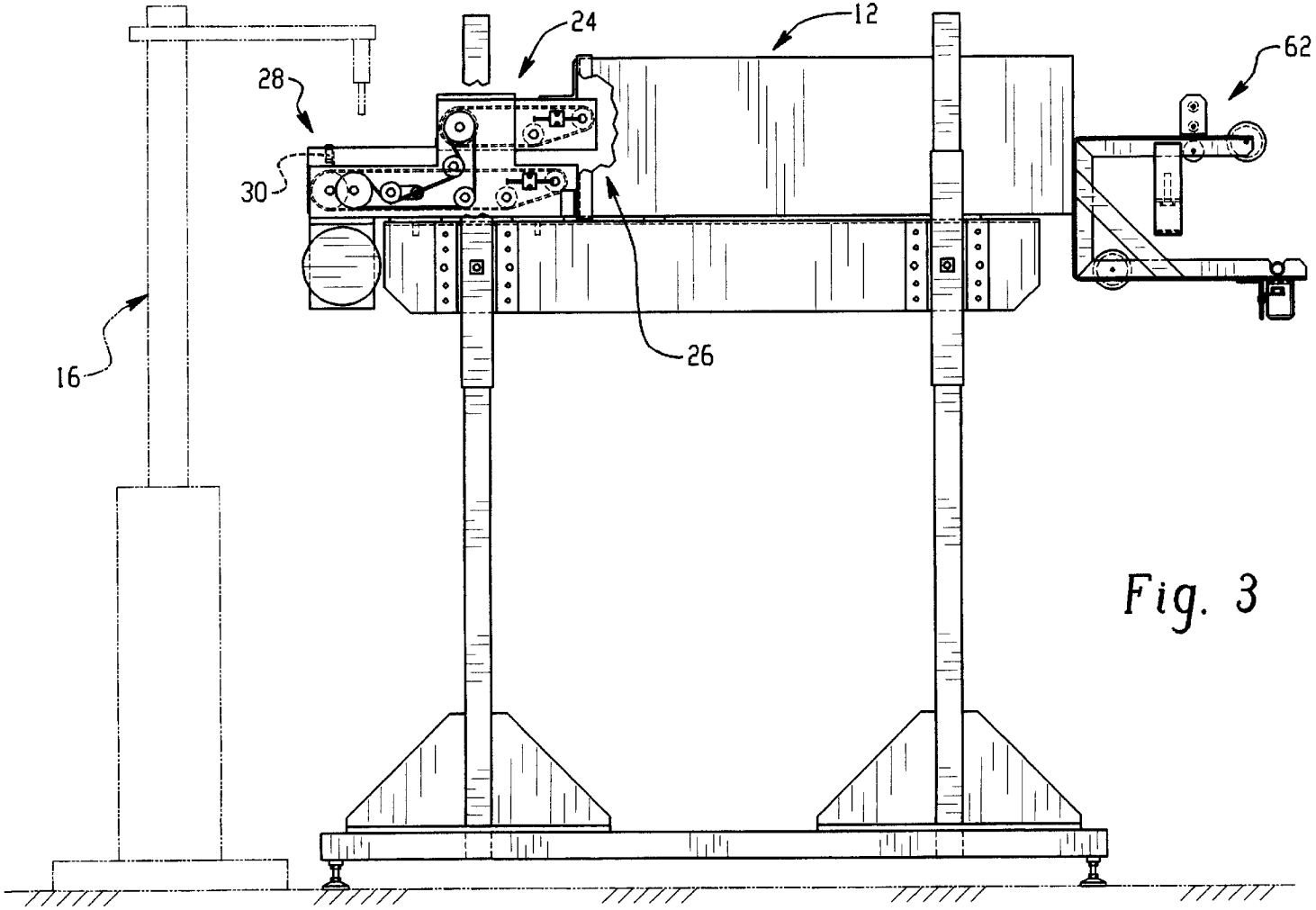
FIG. 3 is an elevational view of a cushioning conversion system of the present invention including a cushioning conversion machine and a pad placement apparatus.
Figure 4:
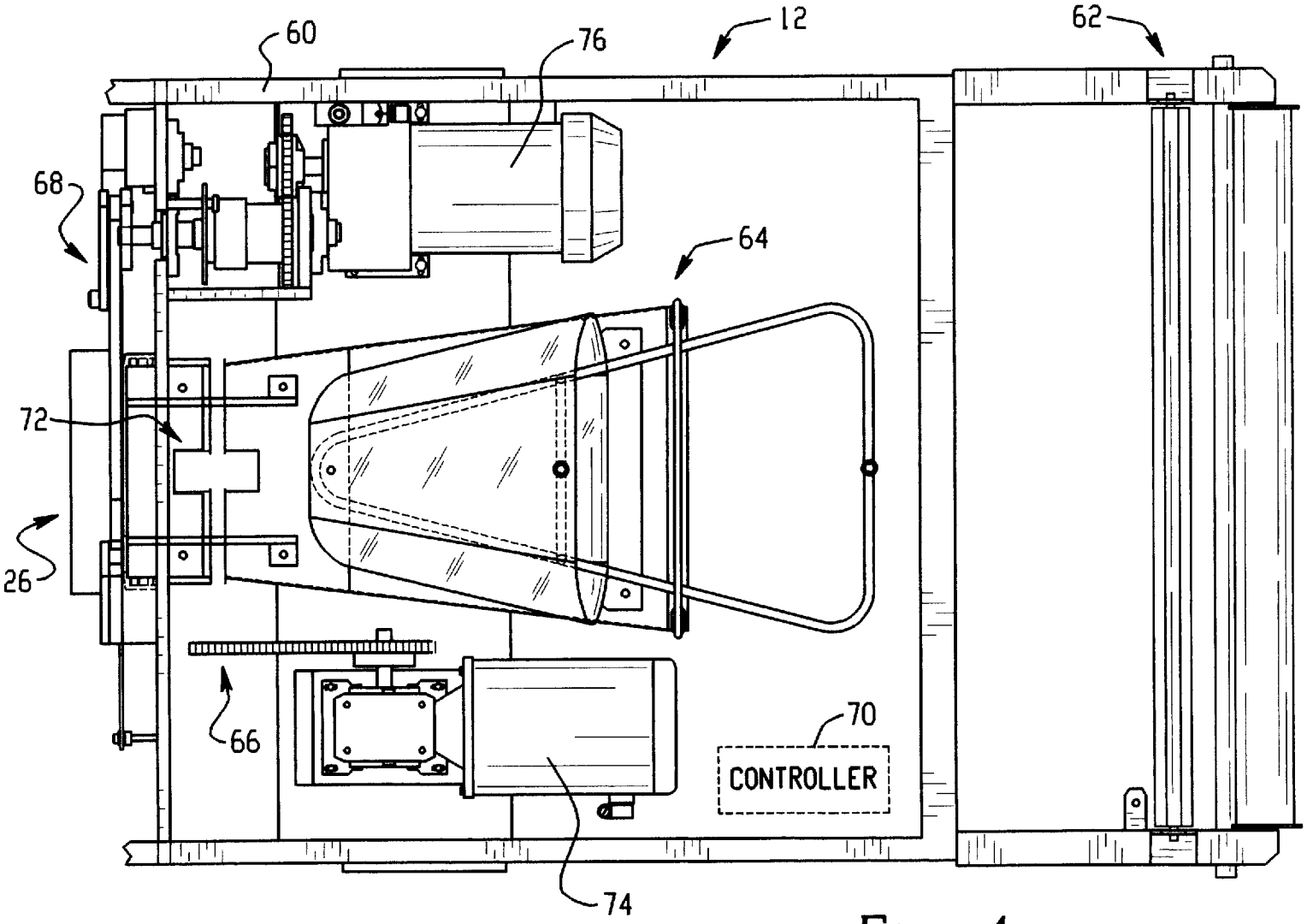
FIG. 4 is partial top view of the cushioning conversion machine.

The upper conveyor belt assembly 82 extends from the machine exit 26 along approximately one-half of the length of the lower conveyor belt assembly 84 thus providing the staging location 28 as the open area between the end of the upper conveyor assembly 82 and the end of the lower conveyor assembly 84 accessible from above by the pad placement apparatus 16 (FIGS. 1 and 3). A pair of rails 90 disposed on either lateral side of the lower conveyor belt 88 confines the pad 14 to a space on the lower conveyor belt and prevents the pad from leaving the area of the conveyor belt or becoming jammed. The rails 90 preferably diverge toward the machine exit 26 to form an area which acts to channel the pad 14 between the conveyor belts 86 and 88. A stop 92 positioned at the end of the lower conveyor assembly 84 prohibits the cut pad 14 from moving beyond the end of the lower conveyor 88. The side rails 90 and the stop 92 cooperate to maintain the pad 14 in the staging location 28 at a known position until it can be retrieved by the pad placement apparatus 16.

Located near the distal end of the lower conveyor belt assembly 84 is the pad sensor 30. The pad sensor 30 is preferably a standard photoelectric sensor capable of both transmitting and receiving an optical signal to detect the presence or absence of an object. Associated with the pad sensor 30 is a retroreflector 94 positioned across the lower conveyor belt 88 from the pad sensor. The pad sensor 30 is located near the stop 92 and detects the presence of a pad in the staging location 28 when the optical path 96 between the pad sensor 30 and the retroreflector 94 is interrupted by the pad 14. Output signals from the pad sensor 30 indicative of the detection of a pad are provided to the machine controller 70, shown in FIG. 4.

The pad conveyor assembly 24 includes a conveyor motor 100 which rotates a pulley 102, as shown in FIG. 6, which in turn powers a drive pulley 104 of the lower conveyor assembly 84 through a belt 106. A drive roller 108 rotating with the pulley 104 provides power to the conveyor belt 88 which follows along drive roller 108 and a path defined by rollers 110 and 112 located near the opposite end of the conveyor assembly 84 in the direction of the arrow 114. A secondary pulley and belt assembly 116 provides power to move the conveyor belt 86 of the upper conveyor assembly 82, as shown in FIG. 7. The secondary pulley and belt assembly 116 includes a pulley 118 having a coaxial gear 120 which is meshed with a gear 122 coaxial with the drive pulley 104. Consequently, the rotational motion of the drive pulley 104 is transferred to the pulley 118 causing the pulley to rotate in the opposite direction of the drive pulley 104. A belt 124 transfers the rotational movement of the pulley 118 to the drive pulley 126 and attached drive roller 128 of the upper conveyor assembly 82 which in turn powers the conveyor belt 86 along a path defined by the additional rollers 130 and 132. In this way, the lower portion of the conveyor belt 86 travels in the direction of the arrow 134 and in the same direction as the upper portion of the conveyor belt 88. Consequently, a pad located in the area 136 formed between the conveyors 86 and 88 will progress away from the exit 26 of the cushioning conversion machine 12 towards the staging area 28. Preferably, the space 136 formed between the conveyors 86 and 88 is divergent in an area 138 confronting the exit 26 of the cushioning conversion machine 12 to guide a formed pad into the space 136 between the conveyors.

The pad conveyor 24 may also be implemented in other manners such as through a series of powered or driven rollers.

Figure 8:
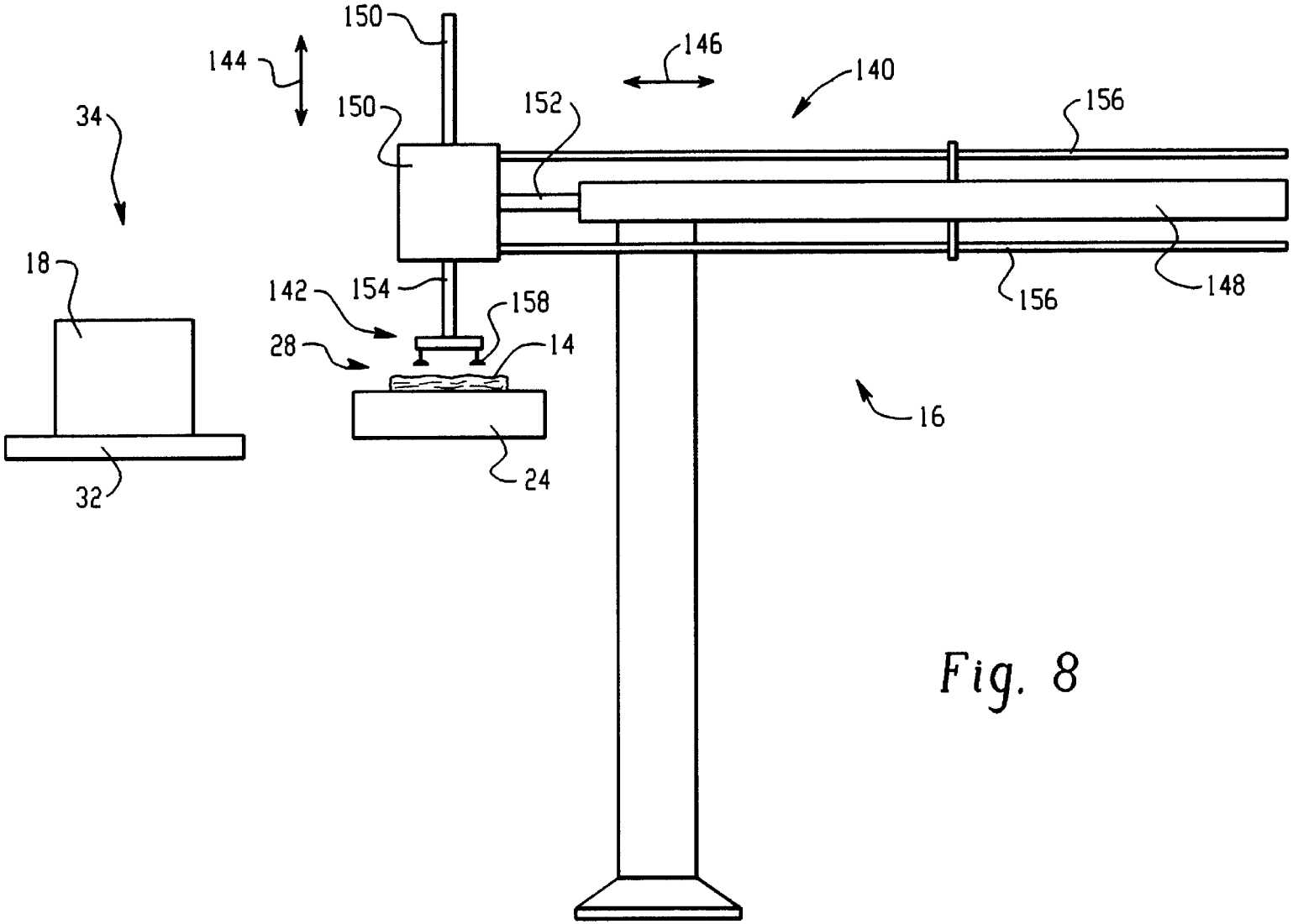
FIG. 8 is a schematic illustration of the pad placement apparatus of the present invention.

The pad placement apparatus 16, as shown in FIG. 8, may be embodied through any number of ways as will be apparent to a person skilled in the art. For example, the pad placement apparatus 16 may include a pick and place unit 140 which is capable of moving a plate or hand 142 for engaging the pad 14 back and forth in vertical and horizontal directions, e.g. the directions denoted by arrows 144 and 146, respectively. The exemplary pick and place unit 140 includes a pair of pneumatically powered, double-acting cylinders 148, 150 controlled by the system controller 22 which move the rods 152, 154 in directions 146, 144, respectively. The cylinders 148, 150 are preferably biased in a retracted position so that upon venting of the pneumatic load or discontinuing power to the cylinders the rods 152 and 154 return to their retracted or rest conditions. The vertical cylinder 150 is mounted to the rod 152 of the horizontal solenoid 148 and guide rails 156 and is positioned so that in the retracted condition of the rod 152 the vertical cylinder is positioned generally above the staging location 28. At the lower end of the rod 154 is mounted the hand 142. Preferably, the hand 142 includes a number of vacuum ports 158 for engaging the pad 14 and holding it against the hand while the hand moves the pad from the staging location 28 to the filling location 34.

In operation, once the pad sensor 30 detects the presence of a pad 14 in the staging location 28, the system controller 22 actuates the vertical cylinder 150 to extend the rod 154 and attached hand 142 to contact the pad 14. The system controller 22 then opens a supply of negative pressure to the vacuum ports 158 causing vacuum ports to engage the pad 14. Upon the hand 142 engaging the pad 14, the system controller 22 powers the vertical cylinder 150 in the opposite direction causing the rod 154 to retract and the hand 142 to return to its rest position. After the hand 142 reaches the rest position, the system controller 22 powers the horizontal cylinder 148 causing the rod 152 to extend to position the hand 142 over the box 18 in the filling position 34. The cylinder is then actuated by the system controller 22 extending the vertical rod 154 causing the hand to lower the pad into the box 18. The vacuum power is then disabled and power is applied to the opposing chamber of the vertical cylinder 150 causing the rod 154 and hand to retract. The system controller 22 then applies power to the opposite chamber of the horizontal cylinder 148 causing the rod 152 to retract and return the hand 142 to the rest position above the staging location 28 to await for another pad to be formed and transported to the staging location 28.

The system controller 22 provides control signals over the signal line 50 (FIG. 2) to the pick and place unit 140 to control the horizontal and vertical cylinders, 148, 150, respectively, as well as to control the supply of negative pressure to the vacuum ports 158. The system controller 22 is preferably also provided positional feedback information over the signal line 52 (FIG. 2) from the pick and place unit 140 by a number of limit or positional switches to assist in coordinating movement of the hand 142 through a cycle to pick up a pad 14 in the staging location 28 and place it in the box 18 at the filling location and return to its rest position over the staging location.

The pick and place unit 140 may also provide for rotating movement in place of or in addition to the horizontal movement of the hand 142. Multiple pick and place units 140 or a pick and place unit having multiple hands may also be employed. Other attachment, engagement or gripping devices may also be used in place of or in addition to the hand 142 with vacuum ports 158.

The automated cushioning system 10 may be used to insert one or more pads of the same of varying lengths into a box either before or after an item is placed in the box or both before and after thereby providing cushioning above and below the item. Further, two or more automated cushioning systems may be used in combination, for example, one system could insert padding into the box before an item is placed in the box and a second system could insert padding into the box after the item is placed in the box in an assembly line fashion.

Figure 9:
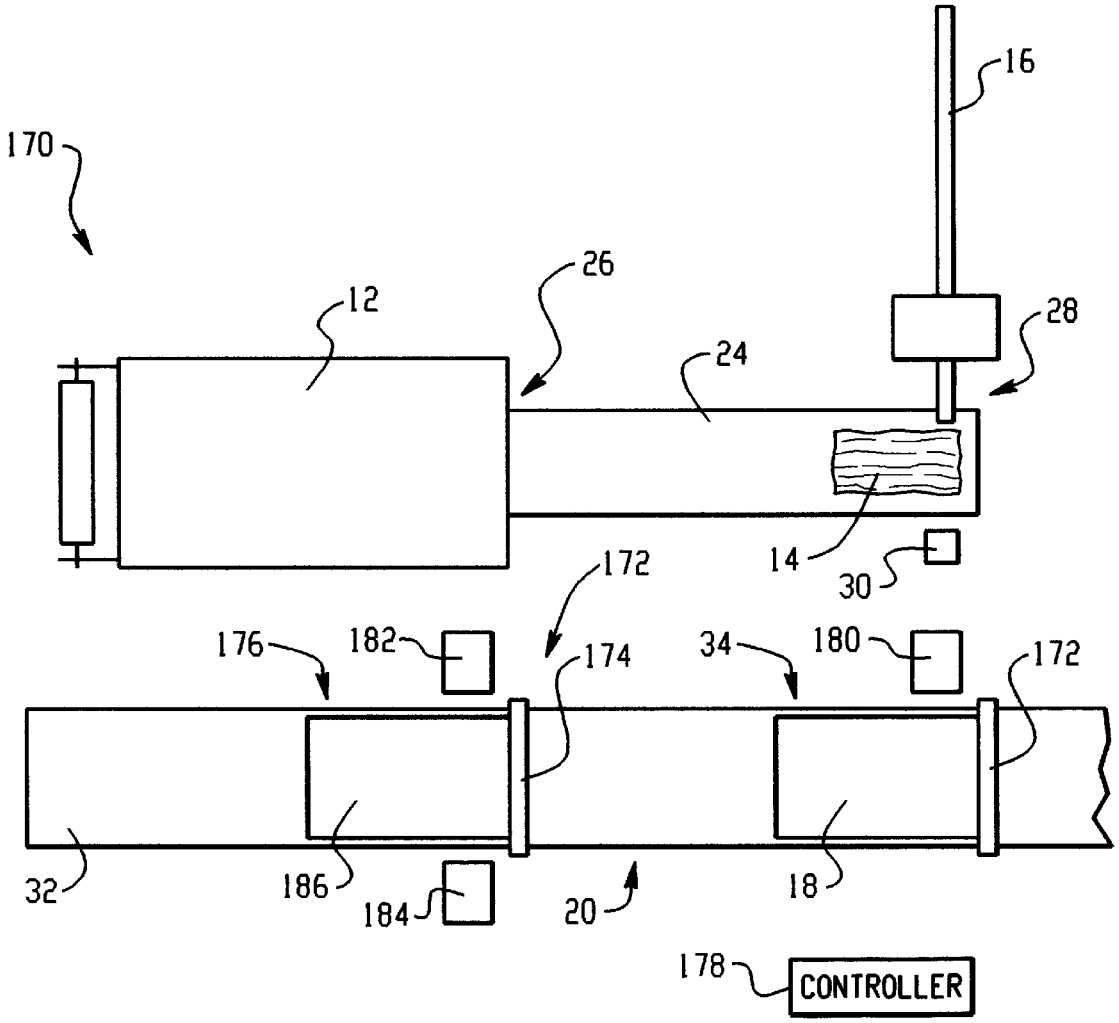
FIG. 9 is an alternate embodiment of an automated cushioning system.

An alternate embodiment of an automated cushioning system 170 including a gating system 172 is illustrated in FIG. 9. The automated cushioning system 170 is configured generally as described above for the automated cushioning system 10, but includes a first gate 172 defining the filling position 34 and a second gate 174 defining a reading or scanning location 176. The gates 172 and 174 are retractable to selectively allow a box to pass thereby on the conveyor 32 or to stop a box in the filling location 34 or reading location 176 as controlled by the system controller 178. A box sensor 180, 182 associated with each box location 34, 176, respectively, provides an indication of the presence of a box in a respective location to the system controller 178. A reading element 184, such as one of the reading elements 38 described above, is positioned adjacent the reading location 176 to read a code associated with the box 186 in the reading location 176 and provides the information regarding packaging requirements, etc., to the system controller 178. The system controller 178 with inputs from the box sensors 180 and 182 and the reading element 184 can thus control the gates 172 and 174 to allow the controlled flow of boxes through the system and to permit information regarding packaging requirements to be read from a box 186 in the reading location 176 while the box 18 in the filling location 34 is being filled. In this manner the system controller 178 can instruct the cushioning conversion machine 12 to begin producing a pad for the box 186 immediately after the last pad needed for the box 18 in the filling location 34 has been removed from the staging location 28 as indicated by the pad sensor 30.

While an automated cushioning system has been described relative to a number of specific embodiments, it will be readily apparent that the present invention has a wide range of applications to many different types and embodiments of cushioning conversion machines, box conveyors and pad placement apparatus.

What is claimed is:

1. An automated cushioning producing and filling system, comprising:

a cushioning conversion machine which converts stock paper into cut pads of a selected length;

a box transporting system for transporting a box to a filling location;

a reading element for reading a code associated the box indicative of the packaging requirements of the box when the box is in the filling location;

a pad transferring apparatus for transferring a formed pad from the cushioning conversion machine to the box;

a system controller for determining the box packaging requirements from the code read by the reading element and instructing the cushioning conversion machine to produce pads in accordance with the packaging requirements for the box; and a pad sensor for detecting the presence of a formed pad.

2. An automated cushioning producing and filling system, comprising:

a cushioning conversion machine which converts stock paper into cut pads of a selected length;

a box transporting system for transporting a box to a filling location;

a reading element for reading a code associated the box indicative of the packaging requirements of the box when the box is in the filling location;

a pad transferring apparatus for transferring a formed pad from the cushioning conversion machine to the box; and a system controller for determining the box packaging requirements from the code read by the reading element and instructing the cushioning conversion machine to produce pads in accordance with the packaging requirements for the box.

3. The system of claim 2, wherein the code reader includes a bar code reader.

4. The system of claim 2, wherein the system controller instructs the cushioning conversion machine to produce the number of pads and the respective pad lengths based on the code associated with the box.

5. The system of claim 2, wherein the box transporting system includes a box sensor for sensing the presence of a box in the filling location.

6. An automated cushioning producing and filling system, comprising:

a cushioning conversion machine which converts stock paper into cut pads of a selected length;

a box transporting system for transporting a box to a filling location;

a reading element for reading a code associated the box indicative of the packaging requirements of the box when the box is in the filling location;

a pad transferring apparatus for transferring a formed pad from the cushioning conversion machine to the box; and a system controller for determining the box packaging requirements from the code read by the reading element and instructing the cushioning conversion machine to produce pads in accordance with the packaging requirements for the box;

wherein the cushioning conversion machine includes a pad conveyor for conveying pads from the machine exit to a staging location from which they are accessible by the pad transferring apparatus.

7. A cushioning conversion system, comprising:

a cushioning conversion machine which converts stock paper into cut pads of a selected length and transports the pads to a staging location;

a pad sensor for sensing the presence of a pad in the staging location;

a box transporting system for transporting a box from a remote location to a filling location;

a code reader for reading a code associated with the box indicative of the packaging requirements of the box;

a pad transferring apparatus for transferring a pad from the staging location to the box when the pad sensor has sensed the presence of a pad in the staging area; and a system controller for determining the box packaging requirements from the code read by the code reader and instructing the cushioning conversion machine to produce pads in accordance with the packaging requirements for the box.

8. The system of claim 7, wherein the system controller determines the packaging requirements for the box through use of a look-up table.

9. The system of claim 7, wherein the cushioning conversion machine includes a forming assembly which causes the lateral edges of the stock paper to move inwardly to form a continuous strip having two lateral pillow-like portions and a central band therebetween.

10. The system of claim 7, wherein the cushioning conversion machine includes a stock supply assembly, a forming assembly for forming the stock paper into the strip of cushioning product, a feed assembly for feeding stock material through the forming assembly and a severing assembly which severs the strip of cushioning product into pads of a desired length.

11. The system of claim 7, including a retractable gate for stopping the box in the filling location prior to being filled and for permitting the box to be transported from the filling location after being filled.

12. The system of claim 7, including a retractable gate for stopping the box at a reading location in a reading location adjacent the code reader and for permitting the box to be transported from the reading location to the filling location.

13. The system of claim 7, wherein the code reader is a bar code reader.

14. The system of claim 11, including a box sensor for sensing the presence of a box in the filling location.

15. The system of claim 12, including a box sensor for sensing the presence of a box in the reading location.

* * * * *